United States Patent [19]

Anderson

[11] 4,234,527

[45] Nov. 18, 1980

[54] EVAPORATIVE CARBURETOR FOR COMBUSTION ENGINES

[76] Inventor: Richard D. Anderson, 419 Columbiana Dr., San Dimas, Calif. 91773

[21] Appl. No.: 68,462

[22] Filed: Aug. 21, 1979

Related U.S. Application Data

[63] Continuation-in-part of Ser. No. 896,934, Apr. 17, 1978, abandoned.

[51] Int. Cl.[3] ..... F02M 21/04

[52] U.S. Cl. ..... 261/102; 261/104

[58] Field of Search ..... 261/102, 104, 105, 99, 261/107, 95, 96

[56] References Cited

U.S. PATENT DOCUMENTS

| | | | |
|---|---|---|---|
| 61,309 | 1/1867 | Boynton | 261/95 |
| 860,334 | 7/1907 | Schell | 261/104 |
| 1,009,121 | 11/1911 | Weiwoda | 261/104 |
| 1,093,718 | 4/1914 | Myers | 261/104 |
| 1,140,000 | 5/1915 | Rubesky | 261/95 |
| 1,664,671 | 4/1928 | Eisengart | 261/107 |
| 2,262,013 | 11/1941 | Lang | 261/105 |
| 2,566,463 | 9/1951 | Orban | 55/385 R |
| 2,669,319 | 2/1954 | Inglesby | 261/99 |
| 2,779,576 | 1/1957 | Morgenroth | 261/64 C |
| 3,336,734 | 8/1967 | Schultz | 261/96 |
| 3,460,680 | 8/1969 | Domnick | 210/315 |
| 3,653,643 | 4/1972 | Tucker | 261/56 |
| 3,722,837 | 3/1973 | Dapprich | 261/107 |
| 3,778,038 | 12/1973 | Eversole et al. | 261/DIG. 56 |
| 3,836,129 | 9/1974 | Perelmutr et al | 261/102 |
| 3,892,547 | 7/1975 | Tucker | 261/96 |
| 4,110,419 | 8/1978 | Miller | 261/104 |

FOREIGN PATENT DOCUMENTS

| | | | |
|---|---|---|---|
| 10346/27 | 11/1927 | Australia | 261/107 |
| Ad. 24815 | 6/1922 | France | 261/99 |
| 1085258 | 1/1955 | France | 261/95 |
| 379150 | 8/1923 | Fed. Rep. of Germany | 261/104 |
| 195407 | 3/1924 | United Kingdom | 261/104 |
| 279000 | 10/1927 | United Kingdom | 261/104 |
| 453996 | 9/1936 | United Kingdom | 261/99 |

*Primary Examiner*—Tim R. Miles

*Attorney, Agent, or Firm*—Boniard I. Brown

[57] ABSTRACT

A carburetor for internal combustion engines has a toroidal fuel evaporation chamber which is defined by an outer cylindrical housing and an inner intake tube shorter than the housing. The carburetor further comprises a bottom wall or floor and an upper wall or roof, which together with other elements define the evaporation or wick compartment and a mixing chamber, as well as a plurality of intake orifices with adjacent inwardly opening valves in the upper wall or roof and about the periphery of the cylindrical housing in the region of the mixing chamber. Throttle plug means are reciprocal in guide means and cooperate with the upper wall member or roof to define a selectively variable throttle opening. A level control device maintains a pre-determined fuel level in the evaporative chamber wherein appropriate wick means are provided for the release of fuel vapor into the air drawn into the mixing chamber of the carburetor, and thence into the engine intake manifold.

9 Claims, 3 Drawing Figures

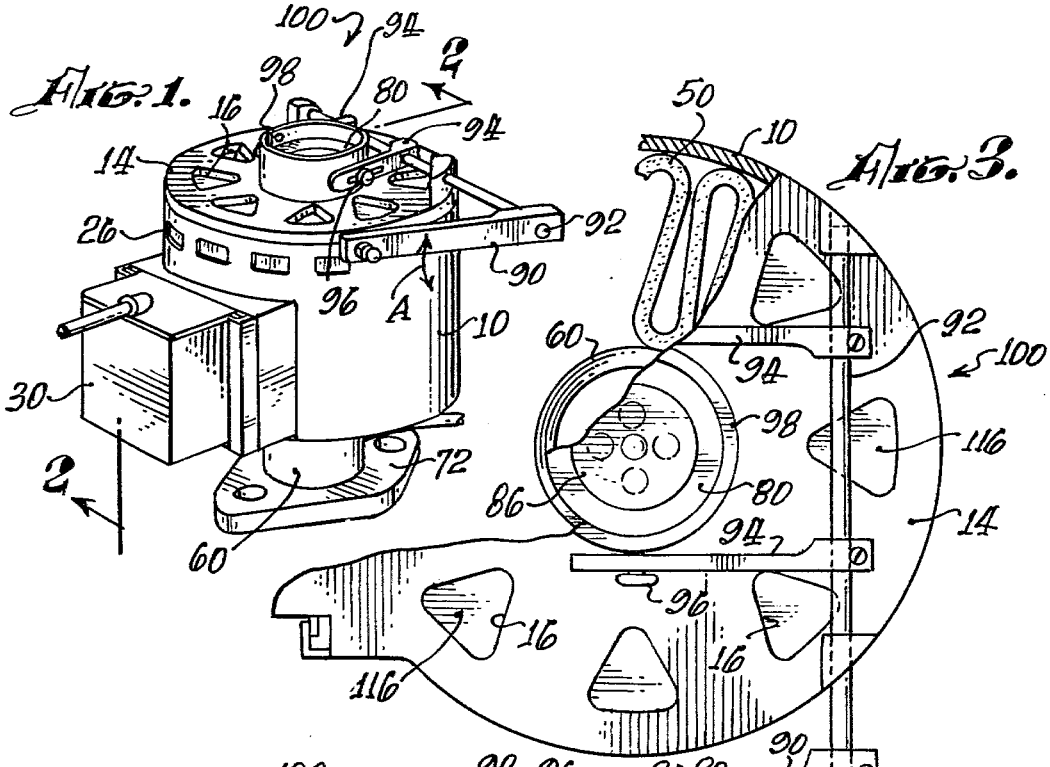
Fig. 1.
Fig. 3.
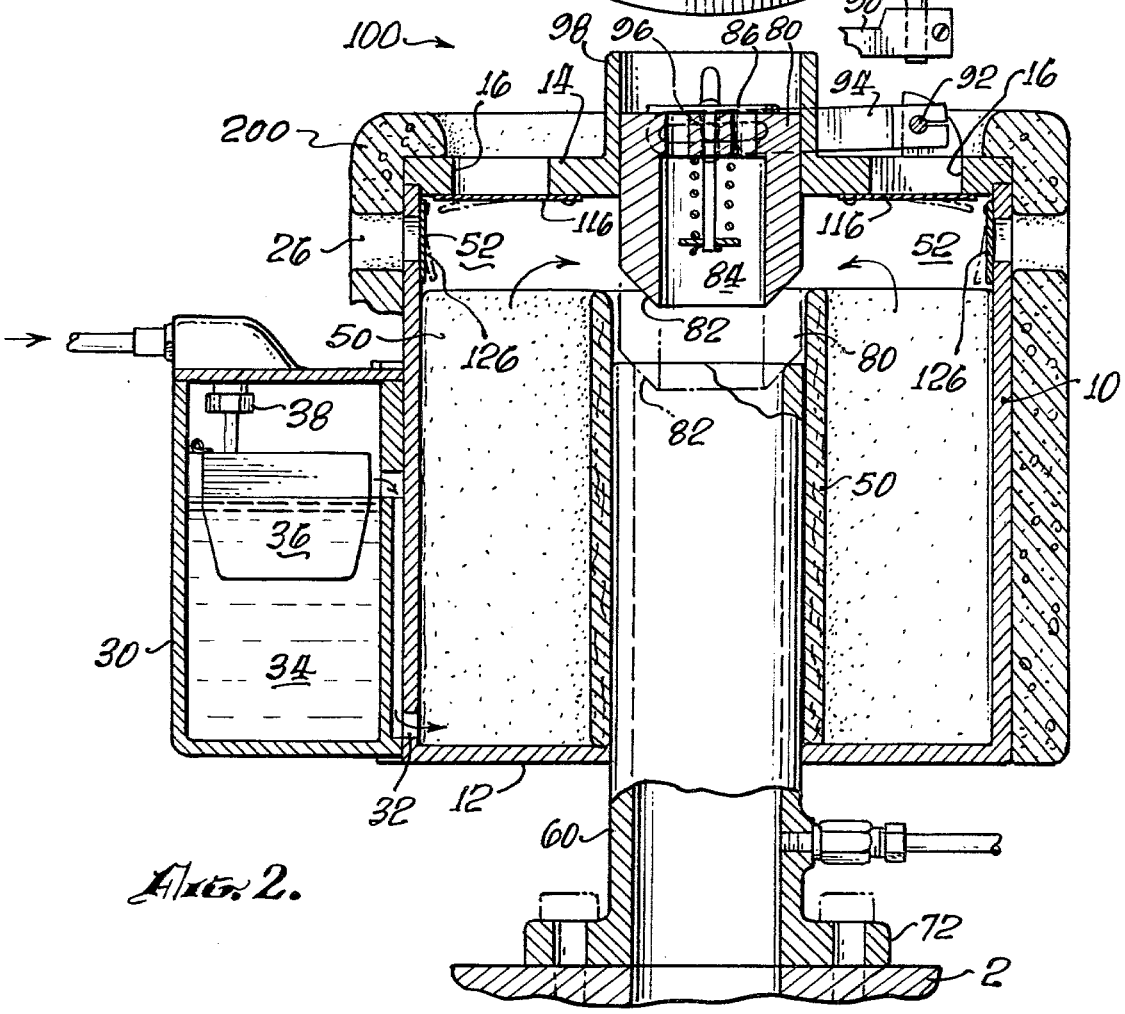
Fig. 2.

EVAPORATIVE CARBURETOR FOR COMBUSTION ENGINES

RELATED APPLICATIONS

This application is a continuation-in-part of application Ser. No. 896,934, filed Apr. 17, 1978, now abandoned.

BACKGROUND OF THE INVENTION

The invention relates to carburetors for spark-ignition engines; it relates, more particularly, to engines utilizing gasoline fuels and equipped with carburetors metering fuel into the intake air stream by evaporation from saturated wick surfaces.

The need for a properly metered and intermixed fuel/air supply at the intake valves of spark-ignition engines has long been recognized, and many types of carburetors for adding the desired amount of fuel—in the form of vapor or finely divided atomized particles—have been proposed. Several carburetting devices of the prior art employ saturated wicks as the primary or secondary source of fuel vapor. Certain prior art structures are described in U.S. Patents including those of ROGERS & WHARRY (No. 403,377) and RUBESKY (No. 1,065,331).

None of the proposed designs of evaporative carburetors met with substantial success due to general reliance on the competitive types of atomizing carburetors, which were deemed more readily adapted to mobile service in automobiles and airplanes.

It is, therefore, the primary object of the invention to teach the construction and operation of an improved evaporative carburetor specifically adapted to automotive service.

It is a further object of the invention to describe the construction of an evaporative carburetor which is simple in design and operation, economical in manufacture and requiring no special skills for maintenance and adjustment.

SUMMARY OF THE INVENTION

The foregoing objects and the advantages deriving therefrom, are attained in a carburetor employing a toroidal evaporative chamber defined between parallel cylindrical walls, the inner one representing the tubular inlet pipe leading to the engine intake manifold. The toroidal chamber is partly filled with a wick constructed by pleating, from planar sheet material of the felted or woven type. The pleating provides the high surface to volume ratio desirable for the rapid release of evaporated fuel, drawn into the wick through a mixing chamber superposed on the evaporative chamber.

The tubular inlet pipe terminates below the top wall of the mixing chamber and cooperates at its upper edge with a valve body to constitute the throttle of the engine.

Air is drawn by the action of the vehicle engine into the mixing chamber through flapper valves, a large number of parallel valve blades being employed in order to provide minimal flow restriction to engine suction and to overcome any influence on flow calibration of the variability of individual valve flapper spring blades.

Because the residence time of the intake air in the chamber is inversely proportional to the engine mass flow, relatively richer mixtures will be produced at low engine speeds, as required for the proper operation of spark-ignition engines. Fuel is admitted into the evaporation chamber at the bottom via a conventional float valve and metering bowl.

BRIEF DESCRIPTION OF THE DRAWINGS

The preferred embodiment of the evaporative carburetor of the invention will be described in detail below, with reference to the accompanying drawing, wherein:

FIG. 1 is a perspective view of the carburetor of the invention, in its preferred form as a downdraft unit with the fuel float chamber mounted en bloc therewith;

FIG. 2 is a transverse section of the carburetor of FIG. 1, taken along line 2—2 in FIG. 1; and FIG. 3 is a partial plan view detailing the valve linkage associated with the throttle valve utilized with the invention, and showing the arrangement of the upper echelon of automatic intake valves.

DESCRIPTION OF THE PREFERRED EMBODIMENT

The perspective view of FIG. 1 shows a carburetor 100, including a housing 10, a float bowl housing 30, and a throttle link 90 movable through an arcuate path 'A' for the control of the throttle valve in the carburetor 100. The cylindrical shell 10 of the housing has an integral bottom wall or baseplate 12 and a removable cover 14. Housing 10 and cover 14 are each perforated by a plurality of openings 26 and 16, respectively, forming the flow passages to automatic flapper valves secured to the inner surfaces of these components.

An axial throttle guide tube 98 in cover 14 provides a cylindrical guide in which a frustro-conical throttle plug 80 is reciprocable between closed or idle and fully open or full power positions under the control of the throttle link 90. The angular travel of the throttle link is transmitted to the throttle plug 80 by levers 94 which engage a throttle shaft 92. The connection between the plug 80 and levers 94 is via pins 96 passing through vertical slots in the sides of the guide tube 98.

FIG. 2 illustrates the internal details of the carburetor 100. A discharge tube 60 extends through a central orifice in baseplate 12 and divides the internal volume of the carburetor into an annular evaporative chamber filled by a pleated wick 50 and into an upper mixing chamber 52 between the upper edge of the tube 60 and the inner surface of cover plate 14. The upper edge of the tube 60 cooperates with a beveled circumferential edge 82 on the throttle plug 80 to form a variable-area flow passage between the mixing chamber 52 and the engine intake system. The latter branches from a manifold pad 2, to which a mounting flange 72, integral with the intake tube 60, is securely mounted, and communicates with the intake valves in the engine to which the carburetor 100 provides the desired air/fuel mixture. In the case of a single cylinder engine, manifold 2 would communicate directly with the single intake valve.

As previously indicated, the float bowl housing 30 is directly affixed to the outer surface of the evaporative chamber housing 10 in the preferred embodiment of the invention, thus to permit the direct discharge of liquid fuel from a fuel chamber 34 into the annular evaporative chamber via orifice 32. The level in the fuel chamber 34 is maintained constant by means of a valve assembly 38 controlled by a float 36. The details of the fuel inlet valve and the associated float bowl form no part of the instant invention, and may be replaced with any other suitable control device for maintaining a constant fuel level in a chamber separate from and communicating with the annular evaporation space within the housing 10.

Since fuel chamber 34 communicates with the annular space containing the wick 50, the wick is immersed in liquid fuel to a depth corresponding to the controlled level in the fuel chamber, the fuel saturating the exposed upper portion of the wick 50 through capillary action. In the exposed upper portion of the wick the fuel evaporates until the fuel vapor filling the open volume between the pleats of the wick 50 reaches the prevailing pressure in the mixing chamber 52. This fuel vapor diffuses into the air in the mixing chamber, driven by the molecular concentration gradient.

As a result of this diffusion effect, a transfer of fuel vapor takes place to commingle with air admitted into the mixing chamber 52. Because the vapor transfer is governed by the speed of the acceptor fluid past the wick surface—in this case the acceptor fluid being the atmospheric air drawn into the mixing chamber through the multiple openings 16 and 26, past reed valves 116 and 126—and since this speed is governed by the flow through the variable restriction defined by the throttle plug 80 and the tube 60, the fuel/air mixture is readily maintained in the desired range of concentration through the engine load range. The enrichment desired at idle and low engine speed is automatically attained by the secondary effect of increased air residence time in the mixing chamber 52.

The primary function of this spring-reed intake valves 116 and 126, associated with openings 16 and 26, respectively, is to prevent the discharge of fuel/air mixture into the atmosphere through diffusion. The occasional occurrence of internal overpressure, due to a backfire or other momentary malfunction, is accommodated by the provision of a reverse-flow valve 86 mounted in the throttle plug. In the preferred embodiment, this takes the form of a simple, spring-loaded poppet valve with an intake channel 84 forming a cavity within the throttle plug 80 in alignment with the mixture tube 60. This arrangement provides for the direct release of reverse-flow gases from the manifold 2 and minimizes the disturbing influence on the operation of the overall carburetor.

An air filter 200, which also serves to provide insulation, is fabricated of an appropriate plastic foam material or other appropriate material with interconnecting pores of small size and is configured to fit about the carburetor housing, as shown in FIG. 2. The filter 200 covers the plurality of openings 16 and the plurality of openings 26 in the upper wall and in the cylindrical housing 10 of the carburetor. There is thus provided a simplified and economic air filter for use with the carburetor of the invention.

The partial top view of FIG. 3 illustrates the arrangement of the throttle controls on the deck plate 14 and, in the cutaway portion of this view, shows the accordioned arrangement of the wick 50. This wick arrangement provides the largest available surface for mass transfer into the vapor phase of the liquid fuel held in the saturated wick, and permits the optimum use of the volume in the evaporative housing, in terms of the volumetric mass transfer efficiency of the carburetor. In the preferred embodiment, a felted material is utilized for the wick, but any suitable porous material capable of being formed into the pleated or serpentine configuration shown may be substituted, provided that it is wettable by the fuel.

It will be evident from the foregoing description that the carburetor of the invention is extremely simple in construction and requires minimal maintenance and adjustment. The overall air/fuel relationship may be controlled by varying the level of liquid fuel in the wick compartment, and by adjustment of the float/valve assembly associated with the fuel chamber. Because of the limited range of such adjustment and the arrangement of the uppermost level attainable below the upper edge of the mixture tube, the danger of flooding the engine with liquid fueld is completely prevented.

It will also be evident that the problems associated with the combustion of finely divided fuel droplets, such as are produced in the orifices of conventional carburetors, are completely eliminated because the fuel is produced in the form of vapor and intermixes with the intake air on a molecular distribution basis. This also avoids the necessity of heating the intake manifold, with the attendant gain in engine performance.

An advantage of the evaporative carburetor of the invention resides in the completeness of the combustion attainable with the admission of fuel into the combustion chamber in the form of vapor. The complex evaporative and combustion processes generally encountered on the surfaces of liquid droplets are not present and the combination of fuel and oxygen molecules can proceed as soon as the combustion-initiating spark is passed through the intake mixture.

The basic principle of the invention resides in the provision of a pleated wick, partly immersed in liquid fuel and serving as a mass transfer device for the conversion of such liquid into the vapor phase, while, simultaneously, channeling the air component of the ultimate fuel/air mixture through a separate mixing chamber so that direct mass transfer of fuel vapor into the airstream from the wick surfaces is avoided. This novel mode of operation for an evaporative carburetor results in the production of combustible mixtures with constant air/fuel ratios over a wide range of air mass flows through the mixing chamber.

Although the invention is described with reference to a preferred embodiment, variations in the mechanical arrangement of the several parts is deemed to be encompassed by the disclosure, the invention being delimited only by the appended claims.

The inventor claims:

1. An improved evaporative carburetor for internal combustion engines operating on liquid gasoline fuel, comprising:

an annular evaporative chamber defined by concentric inner and outer cylinders extending upwardly from a baseplate sealingly encompassing the gap between the cylinders, with said inner cylinder extending upwardly through the baseplate to an elevation below the upper edge of the outer cylinder, cover plate means sealingly affixed above the upper edge of the outer cylinder, a mixing chamber defined by said outer cylinder and said cover plate means, superposed on said evaporative chamber, fuel metering means to maintain a predetermined fuel level in said annular chamber, wick means in the annular evaporative chamber extending from close proximity to said baseplate to an elevation no higher than the upper edge of said inner cylinder, manifold means interconnecting the inner cylinder with the intake manifold of an internal combustion engine, inlet valve means responsive to reduced pressure within said mixing chamber for the admission of atmospheric air into said carburetor, throttle plug means for controlling flow rate into said inner cylinder from said annular chamber, and throttle operating means for controllably varying the axial location of said throttle plug relative to a seat therefor, defined in the upper edge of said inner cylinder.

2. A carburetor according to claim 1, wherein said wick is fabricated of felted textile fiber sheeting.

3. A carburetor according to claim 2, wherein said wick sheeting is folded into a radially pleated array for insertion into said annular chamber.

4. A carburetor according to claim 1, wherein said inlet valve means comprise a plurality of orifices with adjacent spring blades adapted to open inwardly toward said annular chamber.

5. A carburetor according to claim 4, wherein at least one of said orifices is in said cover plate means.

6. A carburetor according to claim 5, wherein at least one of said orifices extends through the peripheral wall of said outer cylinder at an elevation above the upper edge of said inner cylinder.

7. A carburetor according to claim 1, wherein said fuel metering means include a fuel chamber, a float in the fuel chamber and a valve responsive to variations in elevation of said float in said fuel chamber.

8. A carburetor according to claim 1, wherein said throttle plug is reciprocably mounted in a cylindrical guide in said cover plate means.

9. A carburetor according to claim 1, and further including:

air filter means fabricated of appropriate filter material and configured to fit about the housing exteriorly of the inlet valve means, to form part of the air flow path into said annular chamber.

* * * * *